US006138936A

United States Patent [19]

Doering et al.

[11] Patent Number: 6,138,936

[45] Date of Patent: Oct. 31, 2000

[54] METHOD OF USING IONIZED AIR TO REMOVE FROM A COIL THE ELECTROSTATIC CHARGES PRODUCED BY WINDING OF THE COIL ON A CORE

[75] Inventors: Elko Doering, Mörigen; Pascal Cattin, Cressier; Peter Jacob, Zürich; Uwe Thiemann, Gals, all of Switzerland

[73] Assignee: EM Microelectronic-Marin SA, Marin, Switzerland

[21] Appl. No.: 09/277,611

[22] Filed: Mar. 29, 1999

[30] Foreign Application Priority Data

Apr. 6, 1998 [CH] Switzerland ..... 0813/98

[51] Int. Cl.[7] ..... B21C 47/10

[52] U.S. Cl. ..... 242/447.3; 242/906

[58] Field of Search ..... 242/441, 441.2, 242/447.3, 906

[56] References Cited

U.S. PATENT DOCUMENTS 3,636,408 1/1972 Shuman ..... 242/598.3 X
4,860,159 8/1989 Rodrigo ..... 242/906 X
5,393,001 2/1995 Gustafson ..... 242/441
5,531,390 7/1996 Gustafson ..... 242/441.2

FOREIGN PATENT DOCUMENTS

WO 91 00603 1/1991 WIPO .

OTHER PUBLICATIONS

Patent Abstract of Japan, vol. 005, No. 189 (M–099), Nov. 28, 1981.
Patent Abstract of Japan, vol. 006, No. 184 (M–157), Sep. 21, 1982.

*Primary Examiner*—Donald P. Walsh
*Assistant Examiner*—Emmanuel M. Marcelo
*Attorney, Agent, or Firm*—Sughrue, Mion, Zinn, Macpeak & Seas, PLLC

[57] ABSTRACT

A manufacturing method for electronic components (1) including a coil (10), in which a distributing device (34), carrying a pay-out reel (24) on which is wound a winding wire (6), places the wire (6) in contiguous regular turns (8) onto a core (2), this method being characterised in that a flux of ionised air is forced to flow onto the coil (10) during manufacturing to remove electrostatic charges produced during the winding of the coil.

2 Claims, 2 Drawing Sheets

METHOD OF USING IONIZED AIR TO REMOVE FROM A COIL THE ELECTROSTATIC CHARGES PRODUCED BY WINDING OF THE COIL ON A CORE

BACKGROUND OF THE INVENTION

The present invention concerns an improved manufacturing method for electronic components including a coil.

Numerous electronic components include a coil formed of a core generally made of ferrite around which is coiled a very fine wire, of a diameter of the order of a few hundredths of a millimeter.

A manufacturing method for such circuits is known from WO Patent No. 91/00603. This method includes a certain number of steps which will be described succinctly here with reference to FIG. 1 annexed to the present Application.

An electronic component, designated as a whole by the general numeric reference 1, includes a ferrite core 2 which is applied against an integrated circuit 4 by means of a mechanical holding device which is not shown in FIG. 1. A distributing device carrying a pay-out reel, onto which is wound a winding wire 6, is brought into position in order to carry out the winding of core 2. The distributing device, moving longitudinally to core 2 and in rotation about the latter, allows contiguous turns 8 of wire 6 to be laid regularly on core 2. After winding a coil 10 onto core 2, wire 6 is cut and the distributing device is moved in front of the next ferrite core. The free ends 12 and 14 of wire 6 wound onto core 2 are then taken up by a suitable device and applied onto contact bumps 16 of integrated circuit 4.

Electronic components having a coil of the type described hereinbefore are used in particular in the horological industry and the automobile industry where they are used in association with vehicle coded anti-starting systems. In this latter case, integrated circuit 4 and the coil 10 associated therewith which forms a reception antenna are integrated in a tube 18 made of glass or a similar material as shown in FIG. 2 annexed to the present Application. Tube 18 is initially open at one of its ends, and contains a thermosetting epoxy resin 20. After a centrifugation step which allows electronic component 1 to be moved to the bottom of tube 18, the latter is conventionally sealed by means of a high power laser beam. The last step of the method consists in polymerising resin 20 by placing sealed tube 18 in a furnace. Tube 18 is then moulded for example into the thickness of a handle for an automobile switch key. Integrated circuit 4 enclosed in tube 18 includes an identification code which is transmitted by radio-frequency link to the central electronic control unit of the vehicle. After receiving the identification code and checking its authenticity, the central unit orders the unlocking of the vehicle anti-starting system.

The above method has advantageously allowed the manufacture of electronic components including a coil to be mechanised and automated, thus contributing to a significant drop in the cost price of the finished coils. It has nonetheless been noted that this new manufacturing method was accompanied by significant problems of electrostatic discharge. Turns 8 of wire 6 are wound onto core 2 at great speed, typically of the order of 50,000 revs per minute. During winding of wire 6, turns 8 of coil 10 rub against each other, which leads to the appearance of electrostatic charges at the surface of wire 6. Since the outer covering of wire 6 is electrically insulated by means of an insulating lacquer in order to avoid creating short circuits between contiguous turns 8, the electrostatic charges accumulate in coil 10 and cannot be eliminated. In the last step of the method when free ends 12 and 14 of coil 10 are applied onto contact bumps 16 of integrated circuit 4, the static electricity is discharged abruptly into integrated circuit 4 and destroys it. Observed losses due to electrostatic discharge are currently of the order of 20% to 30% of integrated circuits 4.

A manufacturing method for coils for transformers in which a winding wire wound onto a pay-out reel is placed in turns on a reel is also known from Japanese Patent No. 56 108663. Prior to winding the wire onto the reel, the latter is cleaned by means of a flexible brush device, then circulated in a cylindrical conduit into which ionised air is injected for the purpose of cancelling out the static electricity charges which appear in said wire during brushing. This document which can be considered the state of the art closest to the present invention thus suggests cancelling out the electrostatic charges prior to winding the wire onto the reel, and does not raise aforementioned problem of electrostatic discharges. This difference with the present invention is explained by the fact that, in the Japanese document, the electrostatic charges appear during brushing, and it is sought to remove these charges immediately after brushing and prior to winding. Moreover, the winding speeds in question within the scope of the present invention and in the Japanese document are very substantially different. Indeed, in the case of the present invention, the winding speed is very high (of the order of 50,000 revs per minute), hence significant friction between the turns which generated a large number of electrostatic charges which it is sought to remove. Conversely, the Japanese Patent concerns coils for transformers whose dimensions are significant, and for which the winding speed is lower, so that the winding of the wire is not accompanied by the creation of electrostatic charges. Consequently, the Japanese Patent suggests at most installing an air ionising device upstream of the enclosure in which the coil is manufactured, and does neither provide nor suggest any solution to the problem solved by the present invention.

Japanese Patent No. 57 091235, which proposes arranging an air ionising device at the centre of a confined manufacturing enclosure, is also known. This document concerns the manufacture of plastic tapes which is a distant technical field not forming part of the knowledge of those skilled in the art of the invention who, in the present case, are electronic component manufacturers. Further, in this Japanese document, it is sought simply to cancel out the electrostatic charges which appear in the plastic tape on exiting the extruder, during the passage of the tape between the shaping and driving rollers, in order to avoid attracting dust which could become incorporated in the still hot plastic material. The problem raised by the invention, namely to seek to remove the electrostatic charges which are generated during winding of a wire at a very high speed, is not described, nor even suggested.

SUMMARY OF THE INVENTION

An object of the present invention is thus to overcome the above problems and drawbacks by providing a manufacturing method for coils allowing the electrostatic charges which appear during winding of the turns to be removed.

The present invention therefore concerns a manufacturing method for electronic components including a coil, in which a distributing device, carrying a pay-out reel on which is wound a winding wire, places the wire in contiguous regular turns onto a core, this method being characterised in that a flux of ionised air is forced to flow onto the coil during manufacturing.

As a result of these features, the present invention provides a manufacturing method in which the electrostatic charges which appear because of friction of the turns on each other during the winding of a wire onto a ferrite core are cancelled out by electric charges of the opposite sign originating from the ionised air generated by an air ionising device. The wire winding thus becomes electrically neutral, so that its free ends can be welded onto the contact bumps of an integrated circuit without risking destroying it by electrostatic discharge.

The present invention also allows the very difficult problem of monitoring the electrostatic discharges of a moving device to be resolved. It seems difficult to envisage, given the extremely high rotational speed of the distributing device carrying the pay-out reel on which the wire is coiled, connecting this distributing device to earth by means, for example of an electrically conductive wire. As a result of the present invention, it becomes possible to monitor the state of electrostatic charge of a winding manufacturing bench without any contacts and without any fixed connection.

The present invention also relates to a device for implementing the method according to the invention, including a pay-out reel onto which a winding wire is wound and a distributing device which moves longitudinally and in rotation around a core to allow a coil to be placed regularly in contiguous turns on the core, characterised in that an air ionising device arranged inside a frame diffuses ionised air onto the coil during manufacture, the electric charges of said ionised air cancelling out the electrostatic charges of the opposite sign induced by friction in said coil.

BRIEF DESCRIPTION OF THE DRAWINGS

Other features and advantages of the present invention will appear more clearly upon reading the detailed description which follows of an implementation example of the method according to the invention, this example being given purely by way of illustrative and non limiting example, in conjunction with the annexed drawings in which.

DESCRIPTION OF A PREFERRED EMBODIMENT

In the following description, the elements identical to those previously described will be designated by the same numerical references.

Figure 1:
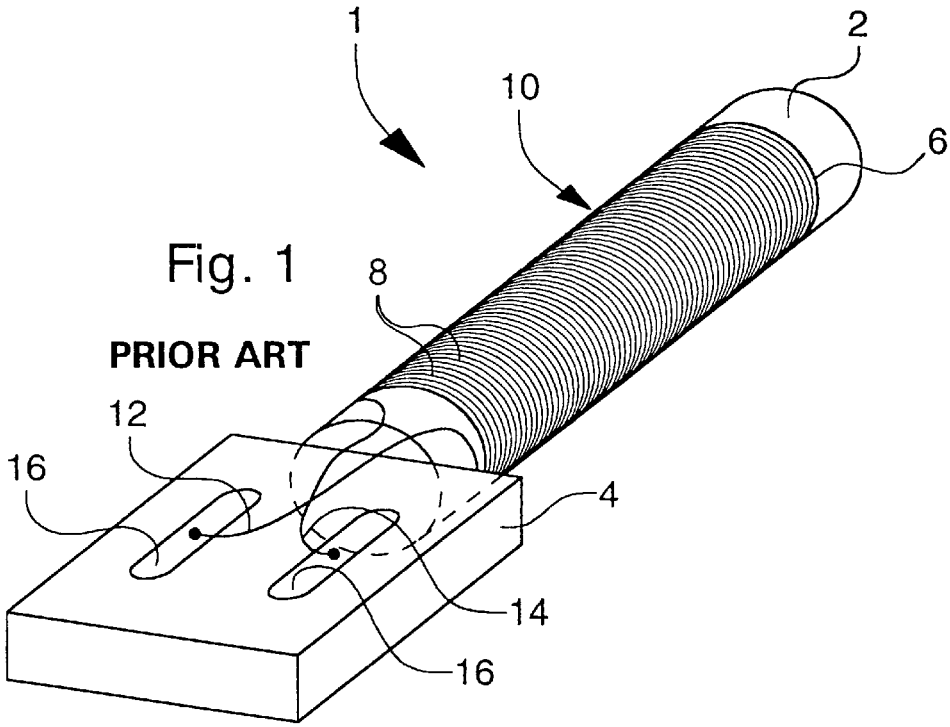
Fig. 1 PRIOR ART
FIG. 1, already cited, is a general perspective view of a winding used as a component of an integrated circuit.
Figure 2:
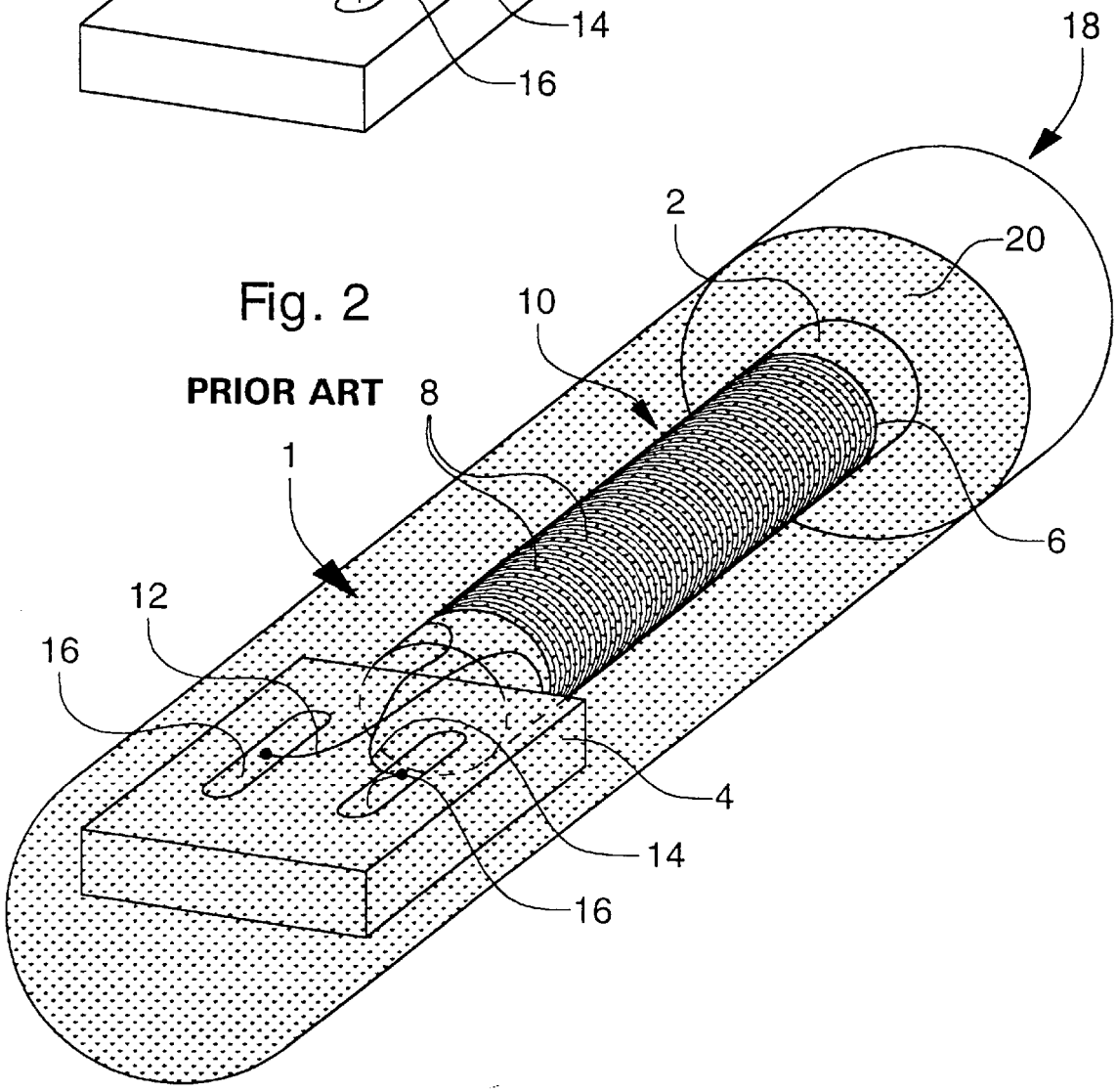
Fig. 2 PRIOR ART
FIG. 2, already cited, is a perspective view of an alternative application of the electronic circuit of FIG. 1.
Figure 3:
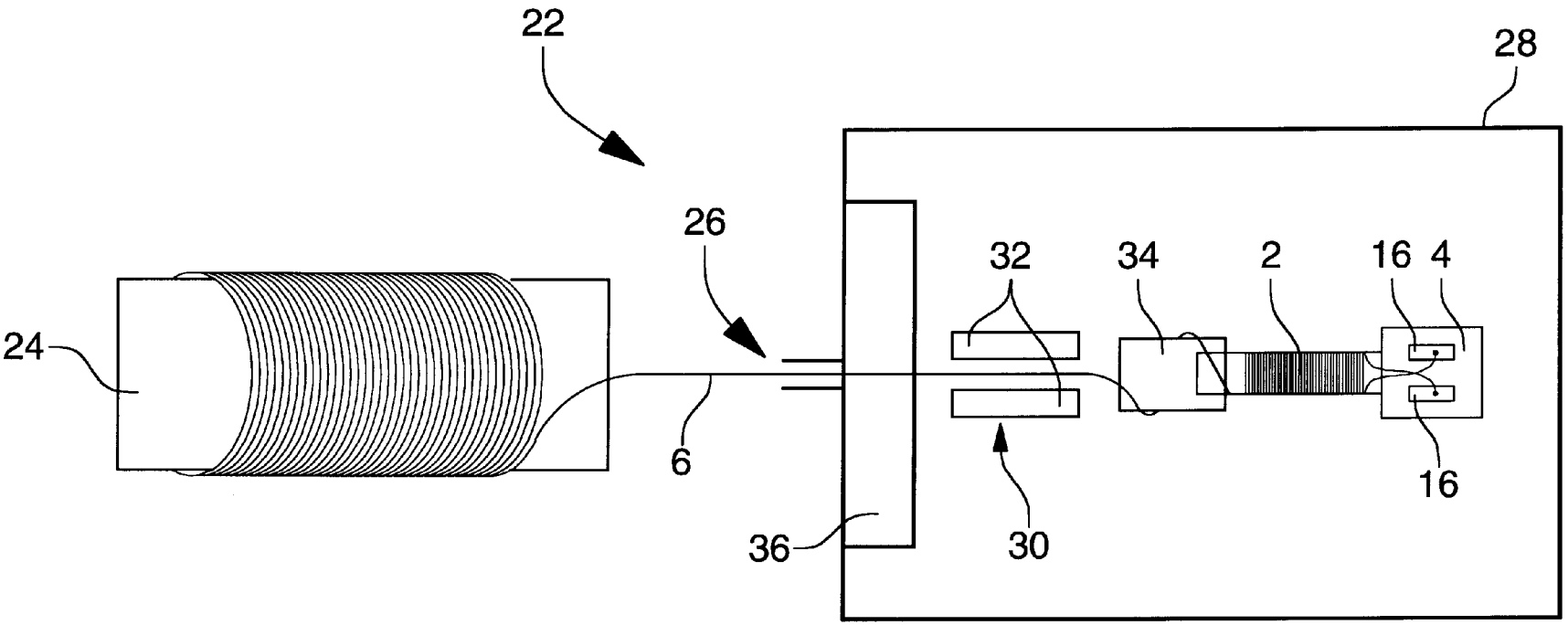
FIG. 3 is a schematic view of the device for implementing the method according to the invention.

The device for implementing the method according to the invention, designated as a whole by the general numerical reference 22 in FIG. 3, includes a pay-out reel 24 onto which winding wire 6 is wound. This wire 6 enters a frame 28 via an opening 26, inside which it is guided in translation by means of a directional guide device 30. This guide device 30 is for example formed of two felt pads 32 which guide and clean wire 6 by friction. It should be noted that this first guiding and cleaning step can constitute a source generating electrostatic charges in wire 6.

Wire 6 is then taken up by a distributing device 34 in position above ferrite core 2. Distributing device 34 which moves longitudinally to core 2 and in rotation around the latter allows wire 6 to be placed regularly in contiguous turns 8 onto core 2. After winding, wire 6 is cut and its free ends 12 and 14 will be applied by thermocompression onto contact bumps 16 of integrated circuit 4.

According to the present invention, an air ionising device 36 is arranged inside frame 28 in which it diffuses ionised air carrying electric charges which cancel out the electrostatic charges of the opposite sign induced by friction in wire 6. Wire 6 thus becomes electrically neutral again and its free ends 12, 14 can be bonded onto contact bumps 16 of integrated circuit 4 without risking destroying the latter by electrostatic discharge.

It goes without saying that various simple modifications and variants fall within the scope of the present invention.

What is claimed is:

1. A manufacturing method for electronic components including a coil, in which a distributing device, carrying a pay-out reel on which is wound a winding wire, winds the wire in contiguous regular turns onto a core to form a coil, said method comprising forcing a flux of ionised air to flow onto the coil to cancel electrostatic charges produced on the coil during the winding thereof.

2. A device for implementing the method according to claim 1, comprising the pay-out reel onto which the winding wire is wound, wherein said distributing device moves longitudinally to the core and in rotation around the latter to allow a winding to be placed regularly in contiguous turns on the core, and wherein an air ionising devices arranged inside a frame, diffuses ionised air onto the winding during manufacture of the coil, the electric charges of said ionised air cancelling out the electrostatic charges of the opposite sign induced by friction during winding of the coil.

* * * * *